US005339897A

United States Patent [19]

Leaute

[11] Patent Number: 5,339,897

[45] Date of Patent: Aug. 23, 1994

[54] RECOVERY AND UPGRADING OF HYDROCARBON UTILIZING IN SITU COMBUSTION AND HORIZONTAL WELLS

[75] Inventor: Roland P. Leaute, Baton Rouge, La.

[73] Assignee: Exxon Producton Research Company, Houston, Tex.

[21] Appl. No.: 989,257

[22] Filed: Dec. 11, 1992

[30] Foreign Application Priority Data

Dec. 20, 1991 [CA] Canada ..... 2058255

[51] Int. Cl.[5] ..... E21B 43/24; E21B 43/243; E21B 43/30

[52] U.S. Cl. ..... 166/245; 166/50; 166/261; 166/263; 166/272

[58] Field of Search ..... 166/50, 245, 256, 261, 166/263, 272

[56] References Cited

U.S. PATENT DOCUMENTS

| | | | |
|---|---|---|---|
| 3,332,489 | 7/1967 | Morse . | |
| 3,960,213 | 6/1976 | Streigler et al. | 166/50 X |
| 4,303,126 | 12/1981 | Blevins | 166/50 X |
| 4,344,485 | 8/1982 | Butler | 166/271 |
| 4,384,613 | 5/1983 | Owen et al. | 166/245 X |
| 4,390,067 | 6/1983 | Willman | 166/245 |
| 4,422,505 | 12/1983 | Collins | 166/245 X |
| 4,434,849 | 3/1984 | Allen | 166/252 |
| 4,463,988 | 8/1984 | Bouck et al. | 166/50 X |
| 4,597,441 | 7/1986 | Ware et al. | 166/272 |
| 4,598,770 | 7/1986 | Shu et al. | 166/245 |
| 4,682,652 | 7/1987 | Huang et al. | 166/263 |
| 4,691,771 | 9/1987 | Ware et al. | 166/245 |
| 4,702,314 | 10/1987 | Huang et al. | 166/245 |
| 4,727,937 | 3/1988 | Shum et al. | 166/245 |
| 4,818,370 | 4/1989 | Gregoli et al. | 208/106 |
| 4,865,130 | 9/1989 | Ware et al. | 166/303 |
| 5,065,821 | 11/1991 | Huang et al. | 166/50 X |
| 5,211,230 | 5/1993 | Ostapovich | 166/50 X |

OTHER PUBLICATIONS

Society of Petroleum Engineers/U.S. Department of Energy, SPE/DOE 9772 "State-of-the-Art Review of Fireflood Field Projects", C. Chu, 1981 SPE/DOE Second Joint Symposium on Enhanced Oil Recovery in Tulsa, Okla., Apr. 5-8, 1981.

Society of Petroleum Engineers, SPE 9994, "Current In-Situ Combustion Technology," C. Chu, 1982 International Petroleum Exhibition & Technical Symposium in Bejing, China, Mar. 18-26, 1982.

Society of Petroleum Engineers, SPE 21773, "Operational Techiques to Improve the Performance of In-Situ Combustion in Heavy-Oil and Oil-Sand Reservoirs," R. J. Hallam, 1991 SPE Western Regional Meeting in Long Beach, Calif., Mar. 20-22, 1991.

*Primary Examiner*—George A. Suchfield

[57] ABSTRACT

Disclosed are a method and apparatus for recovering and/or upgrading hydrocarbons utilizing in situ combustion and horizontal wells. Vertical injection wells are utilized to inject an oxidant into a reservoir for in situ combustion, with the combustion gases vented through vertical wells offset from the injection wells, thus causing the combustion front to travel toward the vertical offset wells. Production of hydrocarbons is through horizontal wells positioned beneath the vertical offset wells. Upgrading occurs when the horizontal wells are shut in and hot fluids injected through the offset wells into hydrocarbons that have accumulated at the bottom of the offset wells.

23 Claims, 8 Drawing Sheets

RECOVERY AND UPGRADING OF HYDROCARBON UTILIZING IN SITU COMBUSTION AND HORIZONTAL WELLS

BACKGROUND OF THE INVENTION

1. Field of the Invention

The present invention relates to methods and apparatus for the recovery of hydrocarbons. In another aspect, the present invention relates methods and apparatus for the recovery or the upgrading of hydrocarbons utilizing in situ combustion.

2. Description of the Related Art

In many parts of the world reservoirs are abundant in heavy oil and tar sands. For example, those in Alberta, Canada; Utah and California in the United States; the Orinoco Belt of Venezuela; and the U.S.S.R. Such tar sand deposits contain energy potential estimated to be quite great, with the total world reserve of tar sand deposits estimated to be 2,100 billion barrels of oil, of which about 980 billion are located in Alberta, Canada, and of which about 18 billion barrels of oil are present in shallow deposits in the United States.

Conventional recovery of hydrocarbons from heavy oil deposits is generally accomplished by steam injection to swell and lower the viscosity of the crude to the point where it can be pushed toward the production wells. In those reservoirs where steam injectivity is high enough, this is a very efficient means of heating and producing the formation. Unfortunately, a large number of reservoirs contain tar of sufficiently high viscosity and saturation that initial steam injectivity is severely limited, so that very little steam can be injected into the deposit without exceeding the formation fracturing pressure. Most of these tar sand deposits have previously not been capable of economic production.

In steam flooding deposits with low initial injectivity the major hurdle to production is the confinement of steam along preferential flow channels between injection and production wells. Several proposals have been made to provide horizontal wells or conduits within a tar sand deposit to deliver hot fluids such as steam into the deposit, thereby heating and reducing the viscosity of the bitumen in tar sands adjacent to the horizontal well or conduit. U.S. Pat. No. 3,986,557 discloses use of such a conduit with a perforated section to allow entry of steam into, and drainage of mobilized tar out of, the tar sand deposit. U.S. Pat. Nos. 3,994,340 and 4,037,658 disclose use of such conduits or wells simply to heat an adjacent portion of deposit, thereby allowing injection of steam into the mobilized portions of the tar sand deposit.

U.S. Pat. No. 4,344,485 discloses a method for continuously producing viscous hydrocarbons by gravity drainage while injecting heated fluids. One embodiment discloses two wells which are drilled into the deposit, with an injector located directly above the producer. Steam is injected via the injection well to heat the formation. A very large steam saturation volume known as a steam chamber is formed in the formation adjacent to the injector. As the steam condenses and gives up its heat to the formation, the viscous hydrocarbons are mobilized and drain by gravity toward the production well (steam assisted gravity drainage or "SAGD"). Unfortunately the SAGD process is limited because the wells must generally be placed fairly close together and is very sensitive to and hindered by the existence of shale layers in the vicinity of the wells. Also, the formation of water-in-oil emulsions which are more viscous than the original bitumen and may slow productivity with steaming methods.

As disclosed by Chu in SPE Paper No. 9772 and SPE Paper No. 9994, the in situ combustion process, ever since its inception in the mid-thirties, has proven to be a significant method for recovering oil, especially heavy oil, and may be undertaken for primary, secondary and tertiary recovery of crude oil, and is employed in situations where the reservoir characteristics and crude oil properties economically justify this recovery approach.

In a conventional in situ combustion process, an oxidant is injected into an input well and combustion is either self-initiated or is initiated by one of many well known methods. It is ideally hoped that the zone of combustion will move as a radial front from the input well and drive the reservoir oil ahead of it to the production well.

U.S. Pat. No. 4,597,441 to Ware et al., discloses a prior art variation on the conventional in situ combustion recovery process, an in situ hydrogenation process in which the hydrogenation temperature is achieved by means of in situ combustion.

In addition to helping produce hydrocarbons, the in situ combustion process has also been used to upgrade or crack hydrocarbons.

Some crude oils are of such low quality and high viscosity that they are produced only with difficulty at a substantially increased expense over light crudes. And once they are brought to the surface they must be prerefined to reduce asphaltic constituents and inorganic catalyst poisons at a cost amounting to as much as fifty percent of the well head price of the oil in order to put them in condition for conventional refining. It would be economically desirable if such an oil could be pretreated in the reservoir and produced as a prerefined upgraded oil.

Upgrading is a relative term which is used to indicate an increase in both quality and value. The upgraded oil recovered from the reservoir will contain a greater proportion of the more valuable lower boiling distillate material and a smaller amount of the less desired high boiling and asphaltic fractions than the virgin oil and may contain only distillate products.

U.S. Pat. No. 3,332,489 to Morse discloses a process for upgrading oil by in situ combustion, which generally comprises injecting oxidizing gas at a high rate into only the bottom of an oil bearing formation, burning out in situ the upper portion of the formation, reducing the rate of the gas injection to stabilize the combustion front and vaporize an upgraded oil product, transporting the vaporized product through the burned out upper portion of the formation, through perforations adjacent only to the top of the formation and into a remote output well and producing to the surface the fluids entering the output well.

While current methods exist for the recovering and upgrading hydrocarbons which utilize in situ combustion, the current methods suffer from several defects. Most notably, the present in situ combustion methods tend to generate in situ combustion gases faster than they can be vented from the reservoir, thus limiting the rate of combustion propagation. The success of any in situ combustion scheme relies heavily on the ability to consistently and simultaneously produce hydrocarbons and vent in situ combustion gases from the formation. Also, with in situ upgrading, the hydrocarbons surrounding the high temperature region of the combustion front becomes high mobile and generally tends to flow toward the producer before it can be reached by the approaching combustion front and upgraded. As a result, only a very small fraction of the produced oil is submitted to the high temperatures necessary to crack and upgrade the oil.

SUMMARY OF THE INVENTION

According to one embodiment of the present invention there are provided a method and apparatus of producing hydrocarbons utilizing a unique arrangement of in situ combustion and horizontal wells. This method and apparatus for recovering hydrocarbons from tar sand deposits comprises first providing in the formation at least one horizontal production well and at least one vertical production well positioned over the horizontal well such that fluids can be circulated between the two wells, and at least one vertical injection well offset from the vertical production well. Next, communication is established between the vertical production and vertical injection wells by injection of a heated fluid through either or both vertical wells toward the other. An oxidant is then injected into the tar sand deposit through the injection well for in situ combustion of the tar sand deposit that either spontaneously ignites or is ignited. Finally, in situ combustion gases are recovered from the vertical production well and hydrocarbons are recovered from the horizontal production well.

According to another embodiment of the present invention there are provided a process and apparatus for recovering hydrocarbons from tar sand deposits through selected production wells utilizing in situ combustion and horizontal wells. The method and apparatus generally comprises first providing in the deposit at least one vertical injection well, a multiplicity of horizontal production wells, a multiplicity of vertical production wells offset from the vertical injection well and each positioned over one of the horizontal wells such that fluids can be circulated between the vertical production well and the horizontal well over which it is positioned; Next, communication between the vertical injection and vertical production wells is established by injection of a heated fluid through either or both vertical wells toward the other. Then an oxidant is injected into the tar sand deposit through the injection well for in situ combustion of the tar sand deposit that either spontaneously ignites or is ignited. Once the in situ combustion is underway, the hydrocarbons are driven towards selected vertical production wells by venting in situ combustion gases from those selected vertical production wells. Lastly, hydrocarbons are recovered from the horizontal production wells over which the selected vertical production wells are positioned.

According to yet another embodiment of the present invention there are provided a process and apparatus for recovering and upgrading hydrocarbons from tar sand deposits, in which there is located a horizontal well with a first vertical well positioned over the horizontal well such that fluids can be circulated between the two wells, a vertical injection well offset from the first vertical well, communication between the first vertical well and the injection well, and in which there is in situ combustion of the tar sand deposits between the first vertical well and the injection well. The process generally comprises first producing hydrocarbons from the horizontal well while in situ combustion gases are being vented from the deposit through the first vertical well and oxidant is being injected into the deposit through the injection well. Next, production of hydrocarbons from the first horizontal well is regulated so that hydrocarbons will accumulate in a region around the bottom of the first vertical well while in situ combustion gases are being vented from the deposit through the first vertical well and oxidant is being injected into the deposit through the injection well. Then a fluid of sufficient temperature to cause at cracking of at least some of the accumulated hydrocarbon is injected into the accumulated hydrocarbons through the first vertical well, while in situ combustion gases are being vented from the deposit through the first vertical well and oxidant is being injected into the deposit through the injection well. Next, the accumulated hydrocarbons may be quenched to below their cracking temperature. Finally, accumulated hydrocarbons are recovered through the first horizontal well.

According to still another embodiment of the present invention there are provided a process and apparatus for recovering and upgrading hydrocarbons from tar sand deposits, in which there is located a first horizontal well with a first vertical well positioned over the horizontal well such that fluids can be circulated between the two first wells, and a second horizontal well with a second vertical well positioned over the second horizontal well such that fluids can be circulated between the two second wells, communication between the first and second vertical wells, a vertical injector well located between that first and second vertical wells, and in which there is in situ combustion of the tar sand deposits between the first and second vertical wells. The process generally comprises first producing hydrocarbons from the first horizontal well while in situ combustion gases are being vented from the deposit through the first vertical well and oxidant is being injected into the deposit through the injection well. Next, production of hydrocarbons from the first horizontal well is regulated so that hydrocarbons will accumulate in a region around the bottom of the first vertical well while in situ combustion gases are being vented from the deposit through the second vertical well and oxidant is being injected into the deposit through the injection well. Then a fluid of sufficient temperature to cause at cracking of at least some of the accumulated hydrocarbon is injected into the accumulated hydrocarbons through the first vertical well, while in situ combustion gases are being vented from the deposit through the second vertical well and oxidant is being injected into the deposit through the injection well. Next, the accumulated fluids may be quenched to below their cracking temperature. Finally, accumulated hydrocarbons are recovered through the first horizontal well. The process can be alternated between the first and second sets of wells.

According to still yet another embodiment of the present invention there are provided a process and apparatus for upgrading hydrocarbons from tar sand deposits, in which there is located a horizontal well with a first vertical well positioned over the horizontal well such that fluids can be circulated between the two wells, a vertical injection well offset from the first vertical well, communication between the first vertical well and the injection well, and in which there is in situ combustion of the tar sand deposits between the first vertical well and the injection well. The process generally comprises first producing hydrocarbons from the horizontal well while in situ combustion gases are being vented from the deposit through the first vertical well and oxidant is being injected into the deposit through the injection well. Next, production of hydrocarbons from the first horizontal well is regulated so that hydrocarbons will accumulate in a region around the bottom of the first vertical well while in situ combustion gases are being vented from the deposit through the first vertical well and oxidant is being injected into the deposit through the injection well. Then a fluid of sufficient temperature to cause at cracking of at least some of the accumulated hydrocarbon is injected into the accumulated hydrocarbons through the first vertical well, while in situ combustion gases are being vented from the deposit through the first vertical well and oxidant is being injected into the deposit through the injection well. Finally, the accumulated fluids may be quenched to below their cracking temperature.

DETAILED DESCRIPTION OF THE INVENTION

Figure 1:
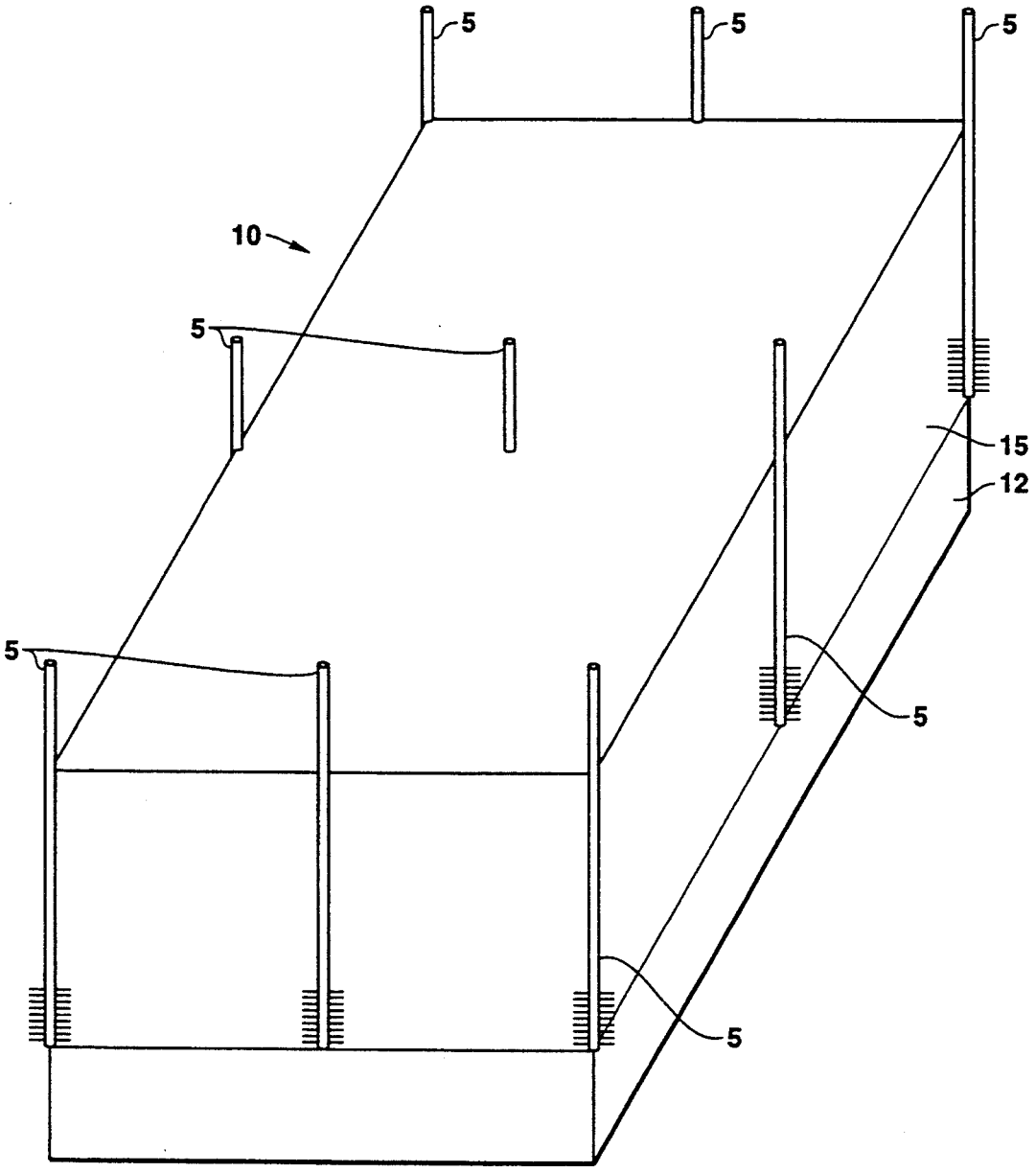
FIG. 1 shows a three dimensional representation of a block of hydrocarbon reservoir 10, having upper sands 15 and lower sands 12, penetrated by nine adjacent vertical wells 5.

The present invention can be best described by reference to the drawings. FIG. 1 shows a three dimensional representation of a block of hydrocarbon reservoir 10, having upper sands 15 and lower sands 12, penetrated by nine adjacent vertical wells 5. The casings in wells 5 contain perforations near the bottom of wells 5. The wells are substantially vertical but may be drilled slightly inclined as directional wells from the surface. Wells 5 in this configuration are used for steam stimulation by sequentially injecting steam and producing fluids for a plurality of cycles. However, as steam stimulation cycles proceed, the thermal recovery efficiency of the steaming process will decline rapidly after only about 15 to about 30 percent of the original oil in place (OOIP) has been recovered. At that stage, typically about 5 to about 15 years after initial introduction of steam into the formation, the remaining hydrocarbon driving mechanisms will only support marginal well productivity. These remaining mechanisms may include interwell steam drive between wells or gravity drainage of hydrocarbons.

Figure 2:
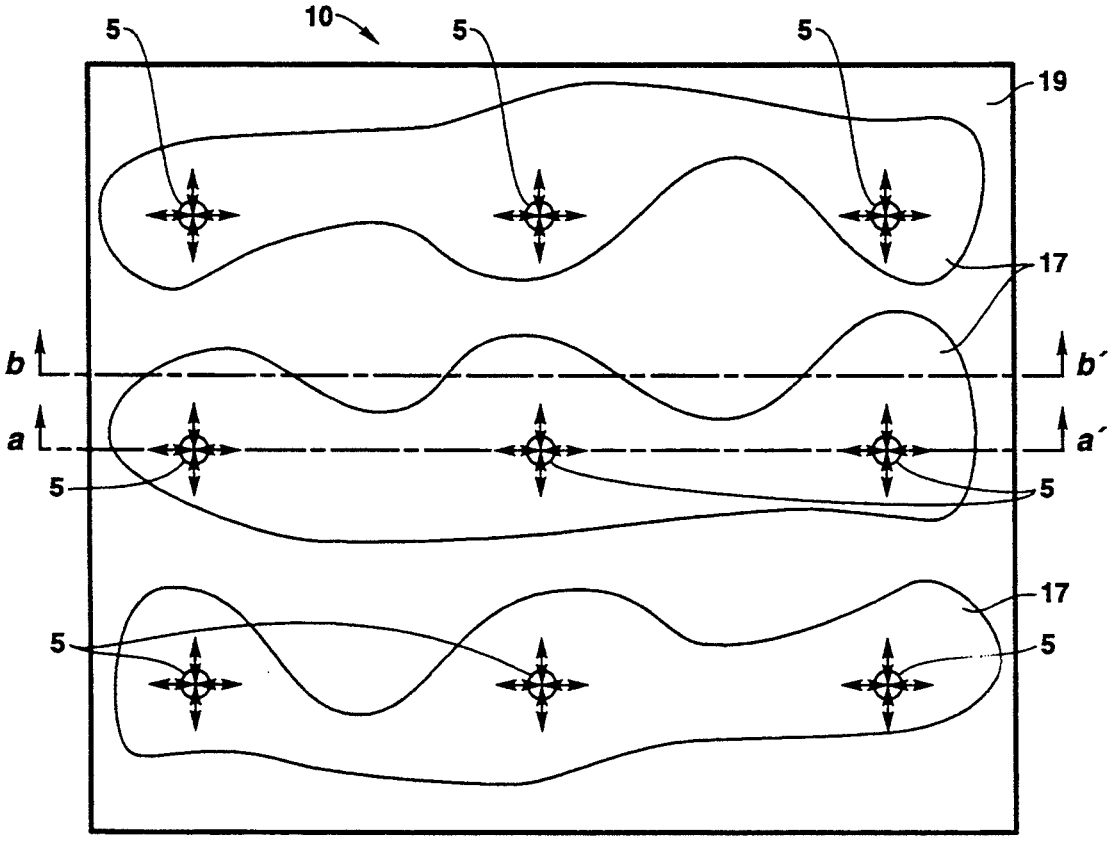
FIG. 2 shows an areal view of oil depletion geometry for reservoir 10 of FIG. 1 after several years of steaming operations.

FIG. 2 shows an areal view of oil depletion geometry for reservoir 10 of FIG. 1 after several years of steaming operations, with wells 5 placed in a grid pattern as shown in FIG. 1. Steam depletion zones 17 and cold zones 19 are shown in FIG. 2. This is the expected effects of gravity on the reservoir after several years of steaming operations as modelled by computer. FIG. 2 also shows the preferential orientation of the interwell communication paths along one direction. This is to reflect, in the case of tar sand reservoirs, the natural orientation state of regional fracturing trends. Because of poor initial injectivities in the virgin reservoir, steam injection pressures must exceed the lower fracturing threshold limits during the early injection cycles. At these pressures, steam penetrates into the formation along elongated channels perpendicular to the direction of minimal horizontal in situ stress. These preferential corridors will also influence the conformance of subsequent follow-up displacement drive processes, as in the application of the present invention.

Figure 2A:
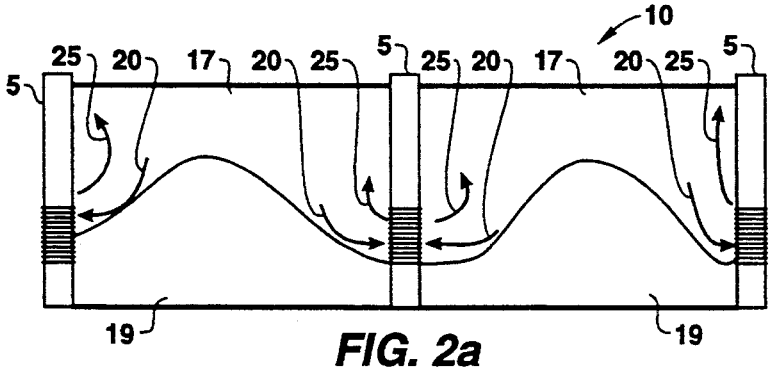
FIGS. 2A and 2B are vertical cross-sectional views of reservoir 10 at lines a—a' and b—b', respectively, as indicated in FIG. 2.
Figure 2B:
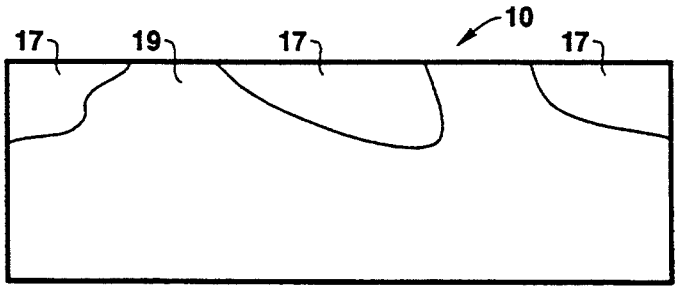

FIGS. 2A and 2B are vertical cross-sectional views along the preferential channel direction of reservoir 10 at lines a—a' and b—b' respectively, as indicated in FIG. 2. Better vertical conformance is generally achieved directly along the interwell communication alignment as shown in the upper cross-section. More laterally in between the group of wells 5, FIG. 2B indicates the tendency of steam to override along the periphery of a typical interwell channel. A larger fraction of the steam injected, arrows 25, is now wasted in reheating the depleted channels, as indicated by arrows 20, making it more difficult to manage the more frequent water/steam communication events between adjacent wells.

Figure 3:
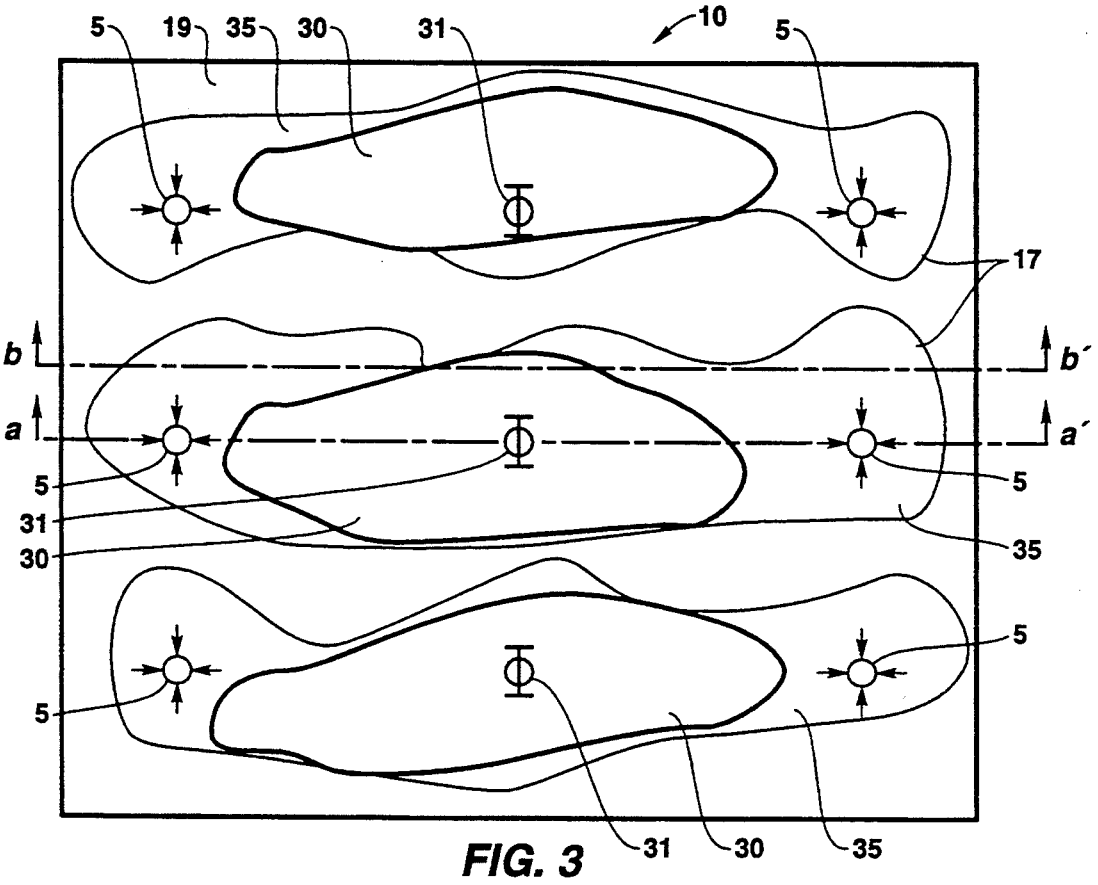
FIG. 3 is a representation of how to adapt a typical prior art in situ combustion process to the dominate template of interwell channels shown in FIG. 2.
Figure 3A:
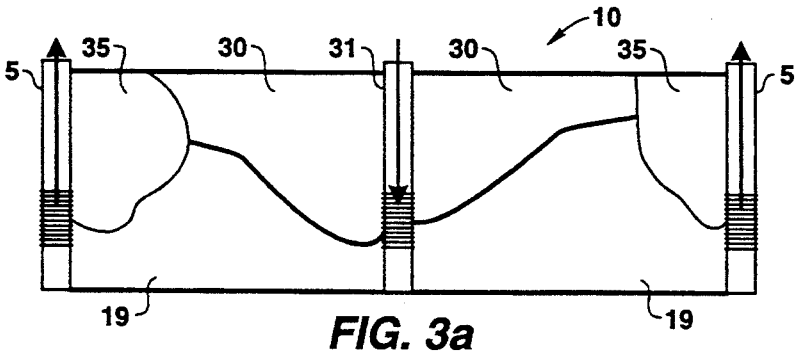
Figure 3B:
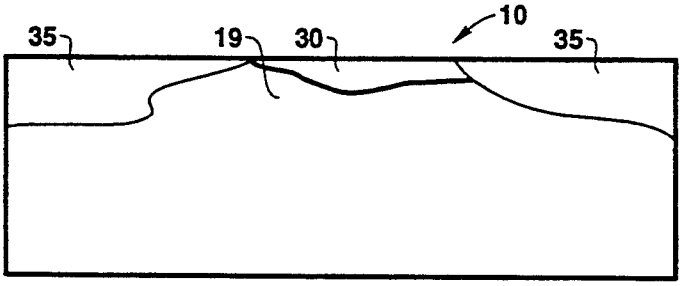

FIG. 3 shows how to adapt a typical prior art in situ combustion process to the dominate template of interwell channels shown in FIG. 2. FIGS. 3A and 3B are vertical cross-sectional views along the preferential channel direction of reservoir 10 at lines a—a' and b—b', respectively, as indicated in FIG. 3. Wells 31 are converted to a permanent line of oxidant injection wells 31. After ignition, the series of combustion fronts will propagate from burn zones 30 via the channels towards steam zones 35 surrounding the two lines of producer wells 5 where gases are removed. The line drive configuration provides flexible injectivity in the utilization of the established channel system to control the conformance of burn zones 30 within reservoir 10. If off-trend communication channels develop across the well patterns, it is necessary to adjust the injection and production strategy by any of the known standard production methods in order to control and balance reservoir sweep. The line drive pattern shown in FIG. 3 results in a low relative ratio of production to injection wells ($P/I=1$). Consequently, the average gas and oil production throughput at each producer need to remain at high levels throughout the combustion phase to be economically feasible. The success of any in situ combustion scheme relies heavily on the ability to consistently and simultaneously produce hydrocarbons and vent in situ combustion gases from the formation. Even though the reservoir has been properly conditioned for efficient propagation of the combustion fronts, the conventional line-drive scheme shown in FIG. 3 does not alleviate these concerns, because it relies on vertical wells 5 to both produce the hydrocarbons and vent the combustion gases.

Figure 4:
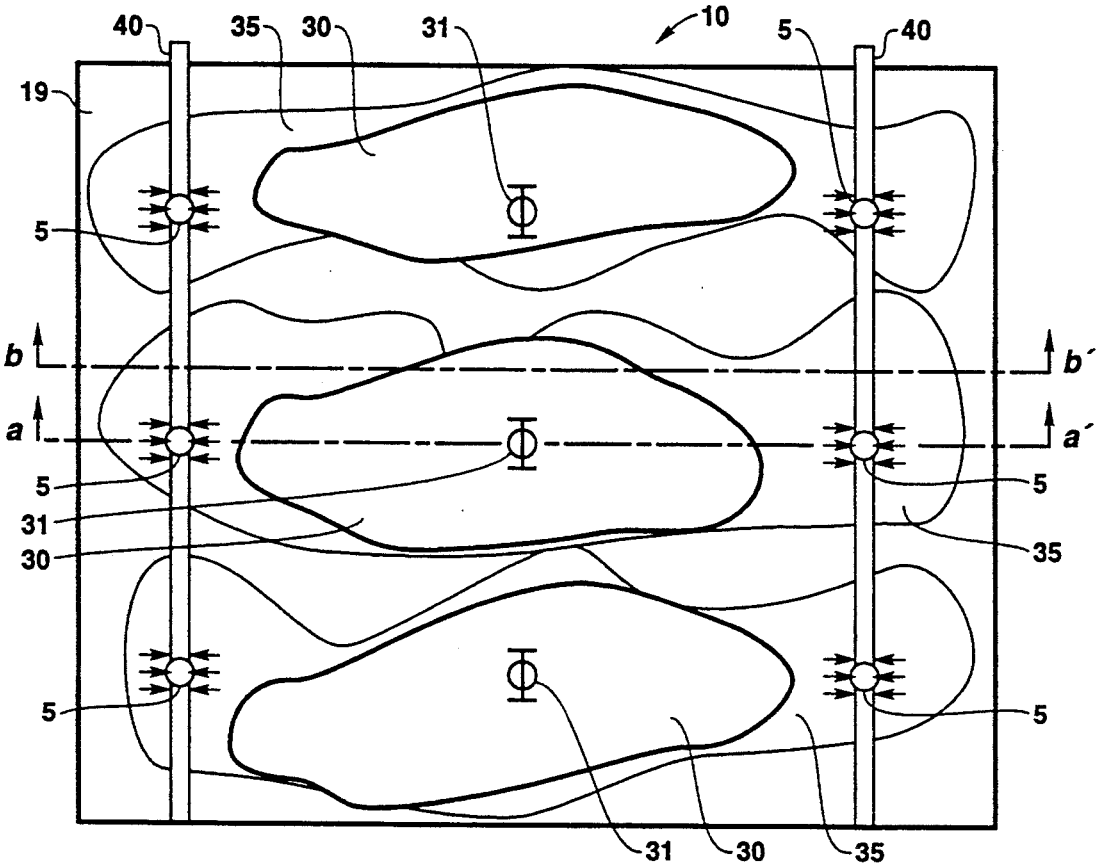
FIG. 4 is an illustration of one embodiment of the present invention as applied to reservoir 10.
Figure 4A:
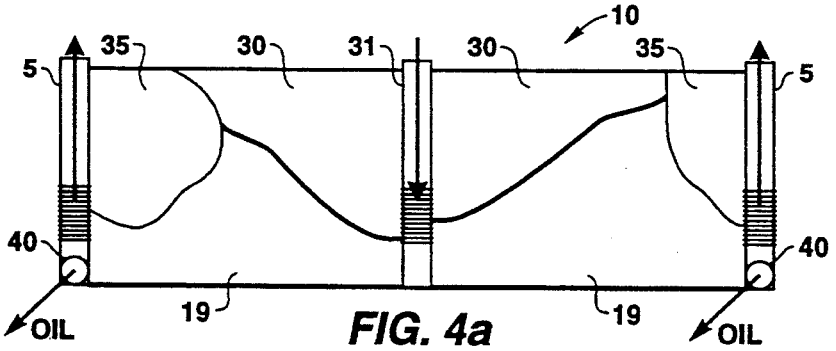
Figure 4B:
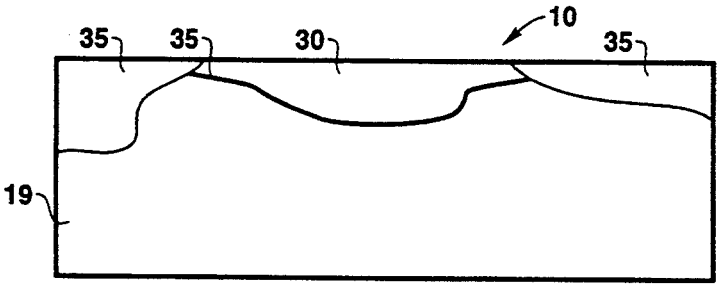

FIG. 4 is an illustration of one embodiment of the present invention as applied to reservoir 10. FIGS. 4A and 4B are vertical cross-sectional views along the preferential channel direction of reservoir 10 at lines a—a' and b—b', respectively, as indicated in FIG. 4.

Horizontal wells 40 have been drilled and located underneath alternate rows of vertical wells in the pattern, i.e., beneath wells 5 and not below wells 31. As in the standard in situ method, oxidant, preferably air or oxygen, is injected into the formation through wells 31 and either ignites or is ignited. After ignition, the series of combustion fronts will propagate from burn zones 30 via the channels towards steam zones 35 surrounding wells 5. All gases are now produced from the reservoir via vertical wells 5, while the hydrocarbon liquids are produced through underlying horizontal wells 40. Horizontal wells 40 preferably contain a slotted liner which may or may not extend the entire length. Generally the horizontal well depth must be such to allow fluids to be readily circulated between horizontal well 40 and wells 5. The horizontal well depth will generally be in the range of about 5 to about 10 meters below wells 5. By manipulating gas throughputs at each injection well 31 and/or wells 5, the operating strategy can be used proactively to manage the development of reservoir sweep across the adjoining patterns of channels. Operational changes in the vertical wells 5 will have negligible impact on the oil production ongoing in the horizontal wells 40. In the event that a combustion front breakthroughs at one of the vertical wells 5, the horizontal production well 40 will remain below the hot spot and the threatened well 5 can be protected. For example, temporary steam injection at the threatened well 5 will assist to redirect the combustion front and prevent the threatened well 5 from overheating. Because of the vastly improved operational flexibility in conducting and stewarding the process behavior, the recovery process may be accelerated without impairing the inflow of fluids across the channel system.

Figure 5:
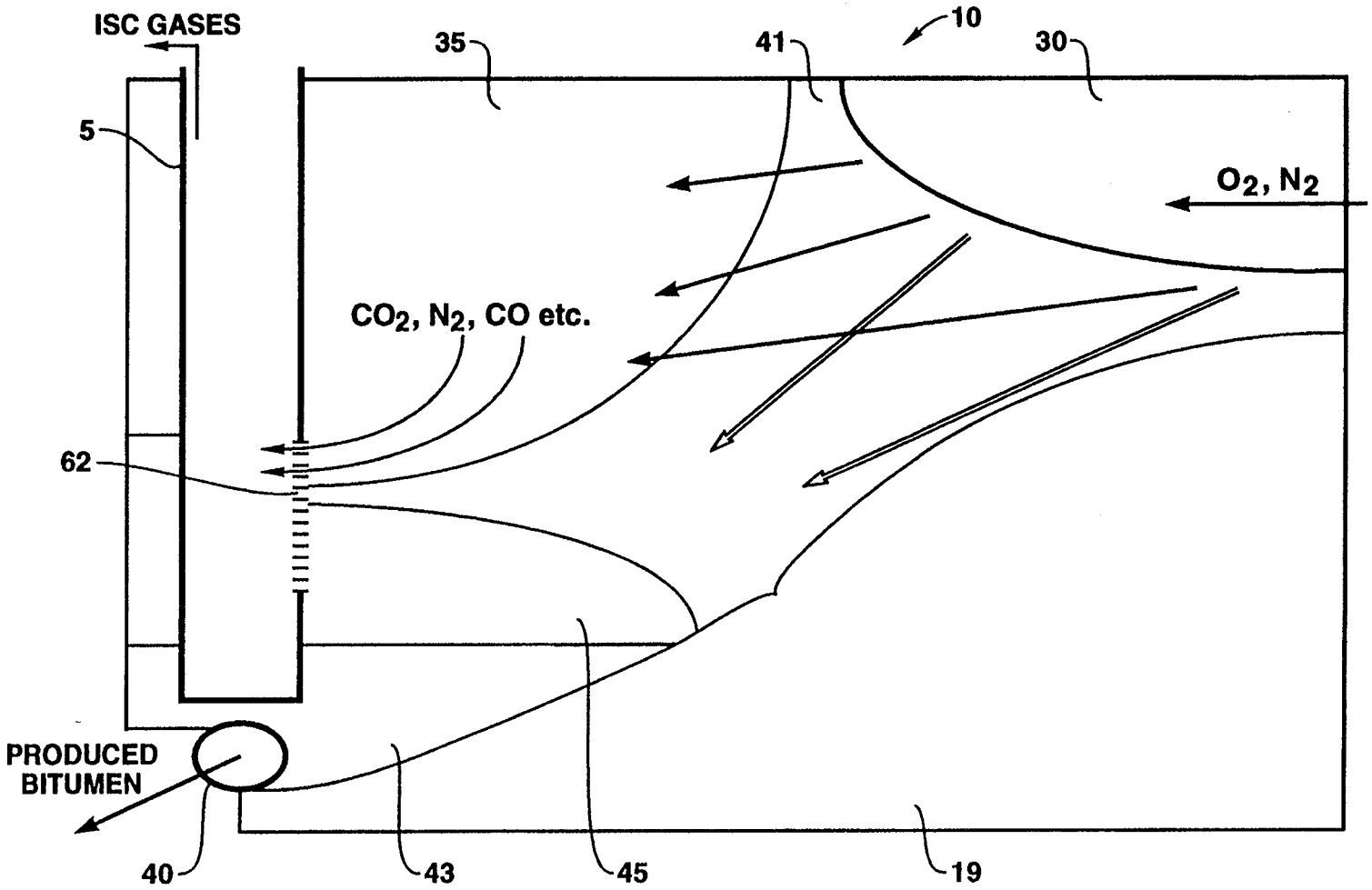
FIG. 5 is a cross-section of reservoir 10 of FIG. 4 in the vicinity of a horizontal well 40-vertical well 5 producing pair, illustrating recovery of hydrocarbons utilizing in situ combustion.

FIG. 5 is a cross-section of reservoir 10 of FIG. 4 in the vicinity of a horizontal well 40-vertical well 5 producing pair. The section is drawn perpendicular to horizontal well 40 and extends to the right towards an adjacent row of injector well 31, not shown in this figure, but shown in FIG. 4. As the burns are initiated from each central line of injectors 31, the natural tendency for the fronts will be to propagate through the steam channels, which most likely have overridden to the top of the reservoir after 5 to 15 years of steaming. As the channels become very hot, the hydrocarbons located near the periphery of the combustion front also becomes very mobile and can readily be banked as shown by bank 41. Under the influence of pressure and gravity, bank 41 will progress towards the lower producing sump 45 above horizontal well 40. The liquid production from inflow 43 is produced through horizontal well 40 simultaneously but separately from the in situ combustion ("ISC") gases (e.g., $CO_2$, $N_2$, CO, etc.) are vented from the formation via vertical wells 5. After reacting at the periphery of the burn zone 30, the ISC gases pass through the steam zone 35 before being vented through the perforations 62 of the vertical wells 5.

For upgrading or cracking, vertical well 5 will have to be provided with an upper set of perforations for venting the ISC gases, and a lower set of perforations for the supplementary injection of a high temperature thermal fluid such as superheated steam into sump 45.

Figure 6:
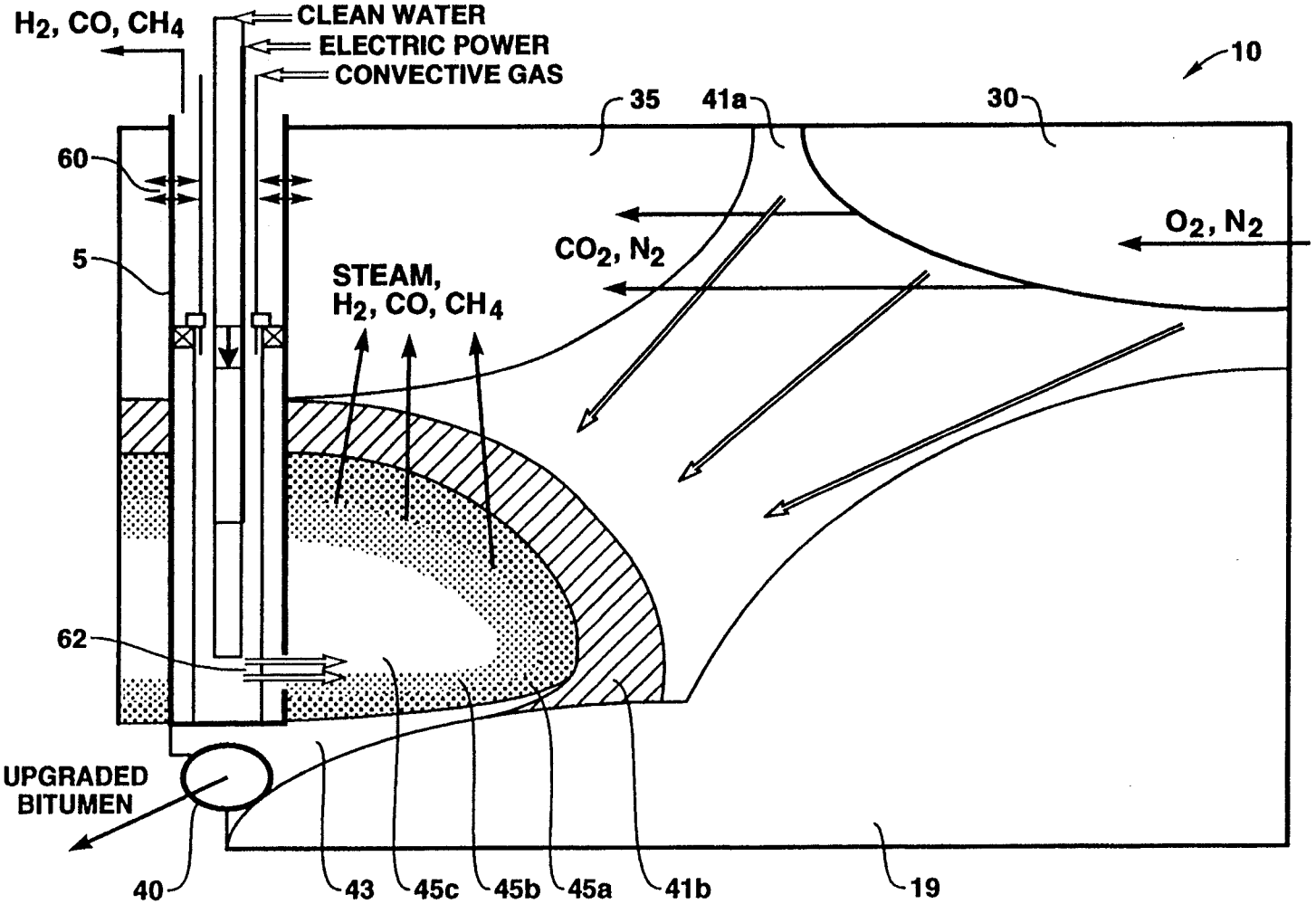
FIG. 6 is a cross-section of reservoir 10 of FIG. 4 in the vicinity of a horizontal well 40-vertical well 5 producing pair, illustrating both recovery and upgrading of hydrocarbons utilizing in situ combustion.

FIG. 6 is a cross-section of reservoir 10 of FIG. 4 in the vicinity of a horizontal well 40-vertical well 5 producing pair, illustrating both recovery and upgrading of hydrocarbons utilizing in situ combustion. Well 5 is outfitted with an upper set of perforations 60 for venting the ISC and cracking gases, and a lower set of perforations 62 for injecting a high temperature thermal fluid. The shadings of sump 45 indicate temperature gradients, with the hotter gradients located nearer to the injected hot fluids. Utilities such as electric power, clean water and convective gas may be supplied through well 5. In the embodiment shown, superheated steam generated by an electric steam generator is injected through perforations 62, although other fluids and generation methods may be utilized.

To upgrade hydrocarbons in sump 45, production through horizontal well 40 is regulated or shut-in to allow a suitable residence time for the thermal fluid to upgrade the hydrocarbons in sump 45. Consequently, there is reduced liquid production from the inflow 43 during upgrading. Upgrading generally requires thermal treatments at severity levels exceeding about 350° C. for several weeks, about 400° C. for several hours or about 500° C. for a few minutes to achieve high boiling point conversions of heavy crudes. The thermal fluid and its temperature will be selected to rapidly heat sump 45 and significantly upgrade the accumulated hydrocarbons in inflow 43 and sump 45 before they are subsequently cooled produced through horizontal well 40. Preferably, super-heated steam in the vicinity of 600° C. is co-injected to prevent rapid coke accumulation in the upgrading zones **45*b* and 45*c***.

Preferably, the upgrading of the hydrocarbons in sump 45 is accomplished utilizing a scheduled cyclic high temperature treatment. Key considerations in designing the duration and frequency of the treatments will be related to both the size of sump 45 and the rate the upgraded bitumen bank **41*b* can be produced and replenished by fresh bitumen from the fresh bitumen bank 41*a***.

Figure 7:
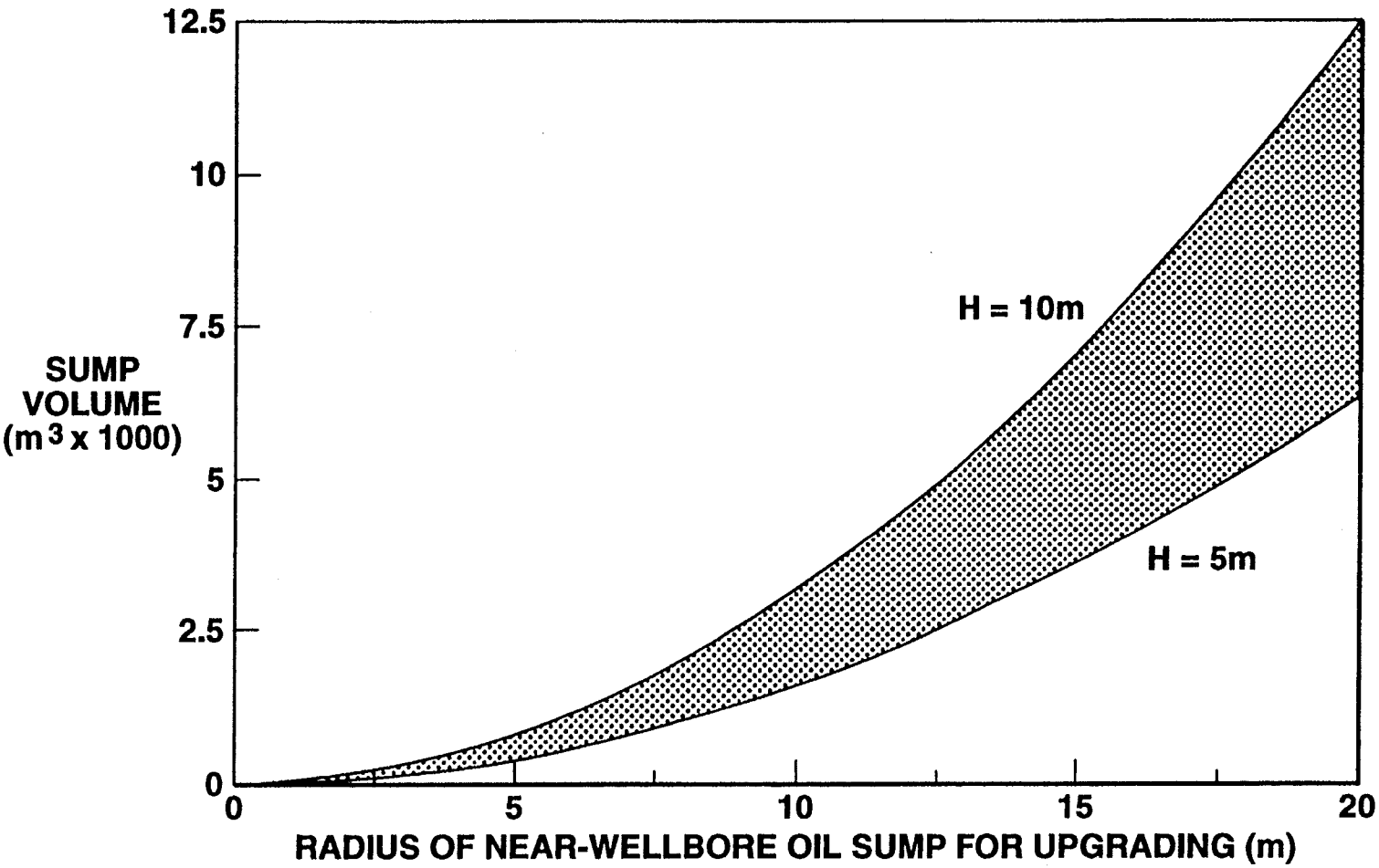
FIG. 7 is a plot of sump volumes plotted as a function of radial extent, assuming a cylindrical oil sump with a typical height of about 5 to about 10 meters.

FIG. 7 is a plot of sump volumes plotted as a function of radial extent, assuming a cylindrical oil sump with a typical height of about 5 to about 10 meters. These formation volumes approximate the extent of the near wellbore upgrading regions targeted for performing in situ upgrading. For example, for sump sizes of 10–12.5m radius, typical reaction zones of 2500 to 5000 $m^3$, with a pore volume of 750 to 1500 $m^3$ correspond to the active reaction zones. A key incentive for using dry in situ combustion methods, in comparison to otherwise more widespread steaming methods, is the much lower water oil ratio in the banked fluids from bank 41. As a result, sump 45 can be replenished at higher oil saturations between treatments, without too much undesirable steam condensate.

EXAMPLE

Figure 8:
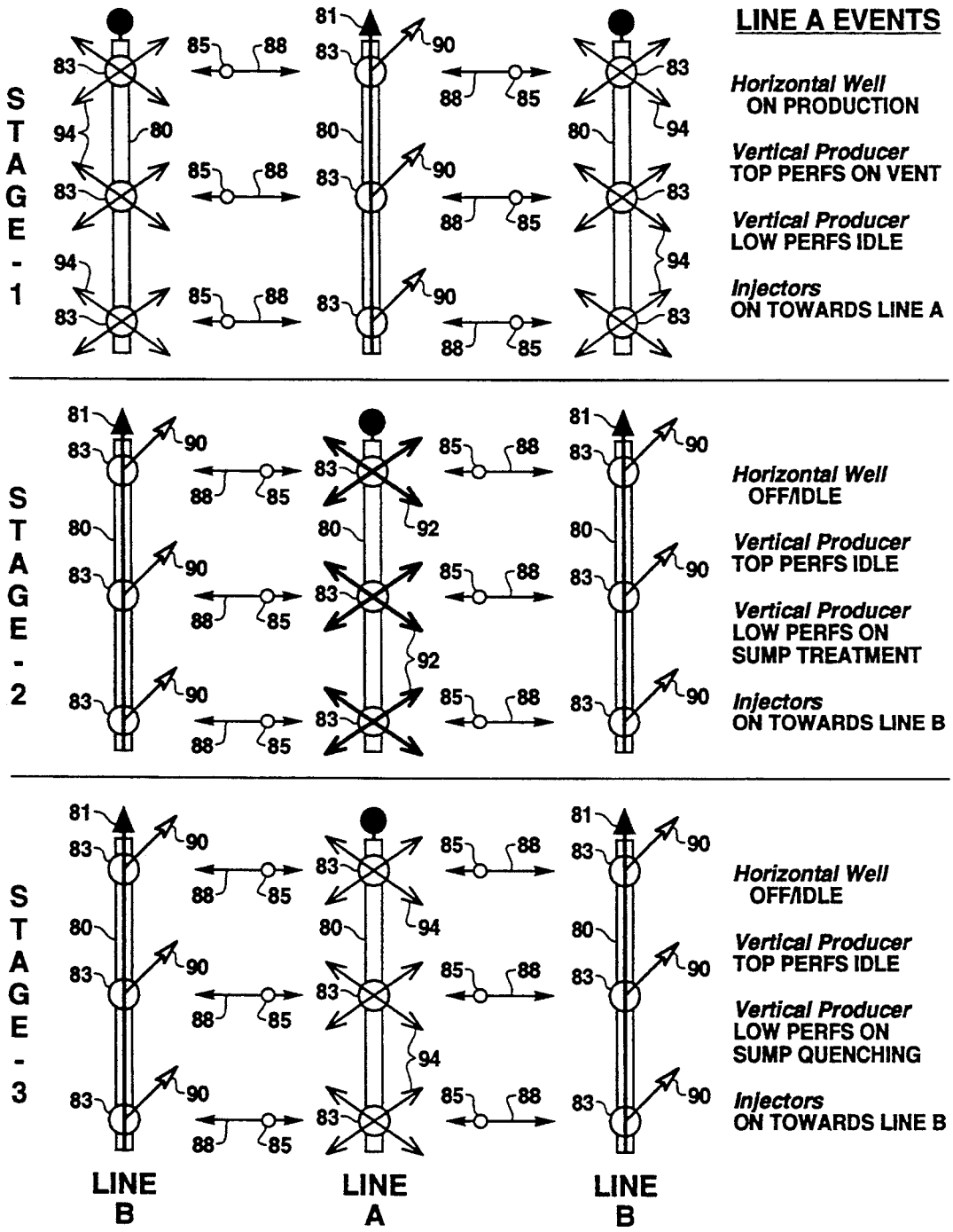
FIG. 8 summarizes the essential steps for applying an embodiment of the process of the present invention.

FIG. 8 summarizes the essential steps for applying one embodiment of the process of the present invention. The present invention allows for continuous operation of all the oxidant injection wells. The lines of combustion fronts between a pair of horizontal wells thus remain active. Cyclic operations will only be carried out near the production wells. During these cycles the active combustion fronts will be propagated preferentially towards one of the two adjacent horizontal wells denoted as Type A or Type B.

FIG. 8 is a view from above of a well arrangement and shows in one Line A and two Lines B, horizontal wells 80, vertical wells 83 positioned over wells 80, and vertical injector wells 85. The same wells are shown in all three stages, so the reference numbers are not necessarily repeated in all three stages. During the first stage depicted at the top of FIG. 8, oil is being quenched to below cracking temperatures at Lines B by the injection of fluid 94 at wells 83, which is hot water or low quality steam, and the oil bank is driven by the combustion fronts towards Line A producers, to be produced through horizontal well 80 as indicated by arrow 81. Oxidant 88 injected at injection wells 85 moves predominantly toward Line A wells, as indicated pictorially by the longer arrow pointing toward Line A wells. At the same time the spent flue gases 90 are withdrawn from the formation in a controlled manner through the upper perforations at each vertical producer 83 in Line A. The oil sumps are progressively replenished as the horizontal producer 80 in lines A are kept on production until the water condensate used for quenching and the upgraded oil (see stages 2 and 3 described later) have been effectively pumped to surface. Rapid deterioration in the quality of the produced oil will be used as an indication to shut-in the horizontal producer 80 in Line A. An average duration of about 2 months is anticipated at the time of this disclosure to implement the first stage of production.

After the Line A horizontal wells 80 are shut-in because of deteriorating product quality, the second stage is initiated by also shutting-in the casings used for venting at the corresponding vertical producers 83 in Line A. The spent flue gases 90 are now withdrawn from the formation in a controlled manner through the upper perforations at each vertical producer 83 in Line B. This will cause the adjacent combustion fronts to be redirected towards the Line B producing wells located in the opposite direction. Oxidant 88 injected at injection wells 85 now moves predominantly toward Line B wells, as indicated pictorially by the longer arrow pointing toward Line B wells. Injection of super-heated steam 92 is then initiated via the bottom set of perforations in the Line A vertical wells a few meters above the horizontal wells. The oil sumps are thus progressively reheated up to cracking and ultimately coke gasification temperature levels near 600° C. The coke that is first deposited between 300°-500° C. is transformed into hydrogen and carbon monoxide products at the higher temperatures. The casings of vertical producers 83 in Line A still remain shut-in to allow gasification products to increase reservoir pressure along Line A. The nearby combustion fronts continue to progress towards the wells in line B, which at this time are in venting and producing mode. The second stage of operation is continued in Line A until a sufficient volume of super-heated steam has been injected to reheat the targeted sump areas to the designed maximum treatment temperature. A volume of 2500–5000m$^3$ should represent a reasonable sump size targeted by the present process. In order to elevate the reservoir volume within the sump up to 600° C., approximately 0.5–1 P.V. pore volume of super-heated steam needs to be introduced at the same temperature (e.g. 750–1500m$^3$ cold water equivalent). The duration of the super-heated steam injection phase will be selected to match the rate specifications of the particular downhole steam generator assembly. In this example, a downhole generator capable of delivering super-heated steam at the sump-wellbore sand face at a rate equivalent to 25–50m$^3$/day may be utilized. At that rate and based on previous steam requirements to heat the sump areas, it will take about one month to complete the upgrading treatment of the oil sumps. The upgraded products are temporarily vaporized and driven in cooler areas beyond the near-wellbore hot zone. At the end of the second stage treatment, a final third stage is initiated to recondition the sumps.

In order to prevent undesirable cracking and coking during flowback production through the very hot sump, it is crucial that the sump region be quenched below cracking temperatures before attempting to flowback the upgraded oil. Accordingly, a short intermediate stage is preferred. It will consist of injecting fluid 94 into the bottome perforations of Line A vertical wells 83, which fluid 94 is hot water or low quality steam. This is accomplished by increasing the water injection rate and turning down the electric power supplied to the downhole steam generator. Assuming a steady water rate of 150–200m$^3$/day, cooling of the sump down to typical steam saturation temperatures of 150°-200° C. should be readily accomplished within about one week.

After quenching the reaction sumps in Line A, the sequence of operations return to those previously discussed under stage one. As indicated in stage one of FIG, 8, the underlying horizontal wells 80 in Line A will be reopened to pump the accumulated water condensate and upgraded product oil. At about the same time, the casing perforations near the top of the formation are reopened for venting the mixture of combustion and gasification gases. It is anticipated that a scheme of surface facilities will be built at each well satellite to allow for the recuperation and separation of the valuable hydrogen and hydrocarbon gaseous products.

The 3-stage operation just described can be alternated between Lines A and B in actual field application. Repetition of these cycles will be conducted to achieve high recovery levels and thus develop the full potential with our invention. As the process develops across the field area, it will be necessary to continuously monitor and balance the reservoir sweep distribution across the various lines of wells. In the likely event that the upper part of some of the vertical producing wells become too hot, when a combustion front comes close, adequate measures must be taken, such as injecting a low rate of low quality steam through the specific casings, instead of continuing to vent combustion gases. Because of gravity segregation and of the rapid quenching of the sump reaction zones, the integrity of the lower horizontal oil producing wellbores are expected to be maintained throughout the entire duration of the present invention.

The invention has been described with reference to its preferred embodiments. One skilled in the art may appreciate from this description changes or variations which may be made which do not depart from the scope or spirit of the invention described above and claimed hereafter.

What is claimed is:

1. A process for recovering hydrocarbons from a formation of tar sand deposits in which there is at least one horizontal production well and at least one vertical production well positioned over the horizontal well such that fluids can be circulated between the two wells, and at least one vertical injection well offset from the vertical production well, said process comprising:

(a) establishing communication between the vertical production and vertical injection wells by injection of a heated fluid through at least one of the vertical wells towards the other vertical well;

(b) injecting an oxidant into the tar sand deposit through the injection well for in situ combustion of the tar sand deposit that either spontaneously ignites or is ignited; and (c) recovering in situ combustion gases from the vertical production well and hydrocarbons from the horizontal production well.

2. The process of claim 1 wherein the oxidant is at least one selected from the group consisting of air and oxygen.

3. The process of claim 1 wherein the heated fluid comprises steam.

4. A process for recovering hydrocarbons from a formation of tar sand deposits in which there is at least one vertical injection well, a multiplicity of horizontal production wells, a multiplicity of vertical production wells offset from the vertical injection well and each positioned over one of the horizontal wells such that fluids can be circulated between the vertical production well and the horizontal well over which it is positioned, said process comprising:

(a) establishing communication between the vertical injection and vertical production wells by injection of a heated fluid through at least one of the vertical wells toward the other vertical well;

(b) injecting an oxidant into the tar sand deposit through the injection well for in situ combustion of the tar sand deposit that either spontaneously ignites or is ignited;

(c) driving hydrocarbons toward selected vertical production wells by venting in situ combustion gases from those selected vertical production wells; and (d) recovering hydrocarbons from the horizontal production wells over which the selected vertical production wells are positioned.

5. The process of claim 4 wherein the oxidant is at least one selected from the group consisting of air and oxygen.

6. The process of claim 4 wherein the heated fluid comprises steam.

7. A process for recovering and upgrading hydrocarbons from tar sand deposits in which there is located a horizontal well with a first vertical well positioned over the horizontal well such that fluids can be circulated between the two wells, a vertical injection well offset from the first vertical well, communication between the first vertical well and the injection well, and in which there is in situ combustion of the tar sand deposits between the first and second wells, said process comprising:

(a) producing hydrocarbons from the first horizontal well while in situ combustion gases are being vented from the deposit through the first vertical well and oxidant is being injected into the deposit through the injection well;

(b) regulating production of hydrocarbons from the first horizontal well so that hydrocarbons will accumulate in a region around the bottom of the first vertical well while in situ combustion gases are being vented from the deposit through the first vertical well and oxidant is being injected into the deposit through the injection well;

(c) injecting into the accumulated hydrocarbons through the first vertical well, a cracking fluid of sufficient temperature to cause at least some cracking of at least some of the accumulated hydrocarbon, while in situ combustion gases are being vented from the deposit through the first vertical well and oxidant is being injected into the deposit through the injection well; and (d) recovering the accumulated hydrocarbons through the first horizontal well.

8. The process of claim 7 wherein the oxidant is at least one selected from the group consisting of air and oxygen.

9. The process of claim 7 wherein the cracking fluid comprises super-heated steam.

10. The process of claim 7 wherein after step (c) the accumulated hydrocarbons are first quenched to below their cracking temperature prior to step (d).

11. The process of claim 10 wherein the temperature of the cracking fluid is at least 600° C.

12. A process for recovering and upgrading hydrocarbons from tar sand deposits in which there is located a first horizontal well with a first vertical well positioned over the horizontal well such that fluids can be circulated between the two first wells, a second horizontal well with a second vertical well positioned over the horizontal well such that fluids can be circulated between the two second wells, and a vertical injection well offset from the first and second vertical wells with communication between the first and second vertical wells and the vertical injection well, and in which there is in situ combustion of the tar sand deposits between the first and second wells, said process comprising:

(a) producing hydrocarbons from the first horizontal well while in situ combustion gases are being vented from the deposit through the first vertical well and oxidant is being injected into the deposit through the injection well;

(b) regulating production of hydrocarbons from the first horizontal well so that hydrocarbons will accumulate in a region around the bottom of the first vertical well while in situ combustion gases are being vented from the deposit through the second vertical well and oxidant is being injected into the deposit through the injection well;

(c) injecting into the accumulated hydrocarbons through the first vertical well, a cracking fluid of sufficient temperature to cause a least some cracking of at least some of the accumulated hydrocarbon, while in situ combustion gases are being vented from the deposit through the second vertical well and oxidant is being injected into the deposit through the injection well; and (d) recovering the accumulated hydrocarbons through the first horizontal well.

13. The process of claim 12 wherein after step (c) the accumulated hydrocarbons are first quenched to below their cracking temperature prior to step (d).

14. The process of claim 12 wherein the oxidant is at least one selected from the group consisting of air and oxygen.

15. The process of claim 12 wherein the cracking fluid comprises super-heated steam.

16. The process of claim 12 wherein the temperature of the cracking fluid is at least 600° C.

17. A process for upgrading hydrocarbons from tar sand deposits in which there is located a horizontal well with a first vertical well positioned over the horizontal well such that fluids can be circulated between the two wells, a vertical injection well offset from the first vertical well, communication between the first vertical well and the injection well, and in which there is in situ combustion of the tar sand deposits between the first and second wells, said process comprising:

(a) producing hydrocarbons from the first horizontal well while in situ combustion gases are being vented from the deposit through the first vertical well and oxidant is being injected into the deposit through the injection well;

(b) regulating production of hydrocarbons from the first horizontal well so that hydrocarbons will accumulate in a region around the bottom of the first vertical well while in situ combustion gases are being vented from the deposit through the first vertical well and oxidant is being injected into the deposit through the injection well;

(c) injecting into the accumulated hydrocarbons through the first vertical well, a cracking fluid of sufficient temperature to cause at least some cracking of at least some of the accumulated hydrocarbon, while in situ combustion gases are being vented from the deposit through the first vertical well and oxidant is being injected into the deposit through the injection well.

18. The process of claim 17 wherein the oxidant is at least one selected from the group consisting of air and oxygen.

19. The process of claim 17 wherein the cracking fluid comprises super-heated steam.

20. The process of claim 17 wherein the temperature of the cracking fluid is at least 600° C.

21. The process of claim 17 further comprising: (d) quenching the accumulated hydrocarbons to below their cracking temperature.

22. The process of claim 21 wherein the quenching is accomplished utilizing a quenching fluid comprising hot water or low quality steam.

23. An apparatus for recovering and upgrading hydrocarbons from tar sand deposits comprising:

(a) a first vertical well positioned in the deposit comprising means for injecting an oxidant into the deposit for in situ combustion;

(b) a second vertical well, offset from the first vertical well, comprising means for venting in situ combustion gases from the deposit and means for injecting an upgrading medium into the deposit;

(c) a horizontal well, positioned beneath the second vertical well such that fluids can be circulated between the two wells, comprising means for producing hydrocarbons.

* * * * *